US006878412B2

(12) United States Patent
Hebeisen et al.

(10) Patent No.: US 6,878,412 B2
(45) Date of Patent: Apr. 12, 2005

(54) CORROSION RESISTANT COMPONENT AND METHOD FOR FABRICATING SAME

(75) Inventors: John C. Hebeisen, Andover, MA (US); Stephen J. Mashl, Chelmsford, MA (US)

(73) Assignee: Bodycote IMT, Inc., Andover, MA (US)

( * ) Notice: Subject to any disclaimer, the term of this patent is extended or adjusted under 35 U.S.C. 154(b) by 0 days.

(21) Appl. No.: 09/817,757

(22) Filed: Mar. 26, 2001

(65) Prior Publication Data

US 2002/0136840 A1 Sep. 26, 2002

(51) Int. Cl.[7] ..... B05D 3/02; B05D 3/12; C23C 4/18; C23C 4/08; B22D 17/02

(52) U.S. Cl. ..... 427/456; 427/455; 427/383.7; 427/370; 29/DIG. 31; 29/418; 29/527.2; 29/527.4

(58) Field of Search ..... 427/451, 455, 427/456, 383.7, 383.5, 370; 29/DIG. 31, 422, 418, 527.1, 527.2, 527.3, 527.4, 527.5, 527.6, 890.01

(56) References Cited

U.S. PATENT DOCUMENTS

| | | | | |
|---|---|---|---|---|
| 3,753,704 A | * | 8/1973 | Manilla et al. | |
| 4,016,008 A | * | 4/1977 | Forbes Jones et al. | |
| 4,137,619 A | | 2/1979 | Beltran et al. | |
| 4,370,789 A | * | 2/1983 | Schilke et al. | 29/156.8 |
| 4,477,955 A | | 10/1984 | Becker et al. | 29/157.1 |
| 4,544,523 A | | 10/1985 | McCollough et al. | 419/8 |
| 4,610,698 A | | 9/1986 | Eaton et al. | 51/295 |
| 4,820,663 A | | 4/1989 | Mehrotra et al. | 501/87 |
| 4,844,863 A | | 7/1989 | Miyasaka et al. | 419/8 |
| 4,956,315 A | | 9/1990 | Mehrotra et al. | 501/87 |
| 4,966,748 A | | 10/1990 | Miyasaka et al. | 419/8 |
| 5,166,471 A | | 11/1992 | Maselli et al. | |
| 5,735,927 A | | 4/1998 | Sanghera et al. | 65/389 |
| 5,822,853 A | * | 10/1998 | Ritter et al. | 29/890.01 |
| 5,956,845 A | | 9/1999 | Arnold | 29/889.1 |
| 6,049,978 A | | 4/2000 | Arnold | 29/889.1 |
| 6,676,825 B1 | * | 1/2004 | Gebhart | 205/660 |

FOREIGN PATENT DOCUMENTS

| | | |
|---|---|---|
| EP | 0 030 055 | 6/1981 |
| EP | 0 106 424 | 4/1984 |
| GB | 2073783 A * | 10/1981 |

* cited by examiner

*Primary Examiner*—Marianne Padgett
(74) *Attorney, Agent, or Firm*—Nutter, McClennen & Fish LLP

(57) ABSTRACT

A process of fabricating a corrosion and erosion resistant component. In one embodiment, the process entails applying one or more corrosion resistant materials onto a pre-formed, sacrificial core and then enclosing this first material and the core with a surrounding capsule. Any space within the capsule is then substantially filled with a second material, after which the capsule is sealed and treated to cause the second material to densify and to metallurgically bond to the first material. Thereafter, the core material and capsule are removed via chemical and/or mechanical processes to yield a component with a shape that approximates the space that existed between the capsule and the first material, and with an outer surface that reflects the shape of the outer surface of the core and the inner surface of the capsule.

17 Claims, 2 Drawing Sheets

CORROSION RESISTANT COMPONENT AND METHOD FOR FABRICATING SAME

CROSS-REFERENCE TO RELATED APPLICATIONS

Not applicable.

BACKGROUND OF THE INVENTION

The present invention relates generally to materials processing and, in particular, to the fabrication of corrosion and erosion resistant components for use in industrial applications.

Historically, steel alloys have been utilized in countless industrial applications. And despite the recent widespread development and commercialization of so-called "high-performance" materials (e.g., alloys, ceramics, and composites), steel alloys are still actively used in many such applications. This is likely attributable to their relatively unique combination of high strength and low cost.

The use of steel alloys in some types of industrial applications, however, is contraindicated. Among such applications are certain offshore oil refineries in which pipes and tubes are used to carry and transport oil. The reactivity of components of the oil (e.g., hydrogen sulfide) causes corrosion of the inner surfaces of the steel pipes/tubes in an unacceptably short amount of time, which can be even further shortened by turbulent flow of the oil and due to abrasion and/or erosion caused by particles suspended in the oil.

One solution to the shortcomings encountered when using steel alloys in fluid transport applications is to instead use components containing high concentrations of nickel, chromium or cobalt in such applications. The problem is that although such components exhibit increased corrosion and erosion resistance, the expense of fabricating such alloys renders their use on such a scale cost prohibitive.

Some in the art have experimented with a compromise, namely lining portions of steel pipes and tubes with corrosion resistant materials in order to gain corrosion resistance. It has proven difficult, however, to do so inexpensively while ensuring that the resulting product not only exhibits increased corrosion resistance, but also is durable and accurately shaped.

Therefore, a need exists for a technique to fabricate a corrosion resistant component from a strong and inexpensive, yet corrosion-susceptible material such as steel by cladding the steel with one or more comparatively expensive, corrosion and/or erosion resistant materials in order to cost effectively increase the corrosion and/or erosion resistance of the steel without hampering its innate strength, and while being able to control the shape of the resulting component.

SUMMARY OF THE INVENTION

The present invention provides corrosion and erosion resistant components and a method of fabricating such components by metallurgically bonding at least two different materials together. Although the invention is primarily shown and described in conjunction with fabricating industrial components such as valves, pipes and tubes, it is understood that linear and non-linear shaped components of nearly any size, specific shape, and function may be fabricated on any scale in accordance with the present invention.

In an exemplary aspect of the present invention, a first corrosion or erosion resistant material is applied onto a core or substrate via an appropriate metallic spray technique. The core and layer of first material are then at least partially enclosed by a surrounding capsule such that an empty space is defined within the capsule. This space is substantially filled with a second material (e.g., a metallic powder), after which the capsule is sealed and then processed to cause the second material to densify and to metallurgically bond to the first material.

Thereafter, the core material and capsule are removed chemically and/or mechanically to leave a fabricated component. The component will have a shape and size approximating that of the space that had been defined between the capsule and the layer of first material.

In one aspect of the present invention, the compositions of the first and second materials are adjusted (e.g., by modifying the feed of the metal powder to the spray deposition device) to provide a compositional gradient, which, in turn, serves to diffuse the stresses that may be generated by differences in the thermal expansion of the first and second materials. Because these stresses are diffused, a component fabricated in accordance with the present invention not only is accurately shaped and corrosion resistant, but also is less susceptible to cracking and, therefore, is highly durable.

BRIEF DESCRIPTION OF THE DRAWINGS

The invention will be more fully understood from the following detailed description taken in conjunction with the accompanying drawings, in which.

DETAILED DESCRIPTION OF THE INVENTION

Figure 1:
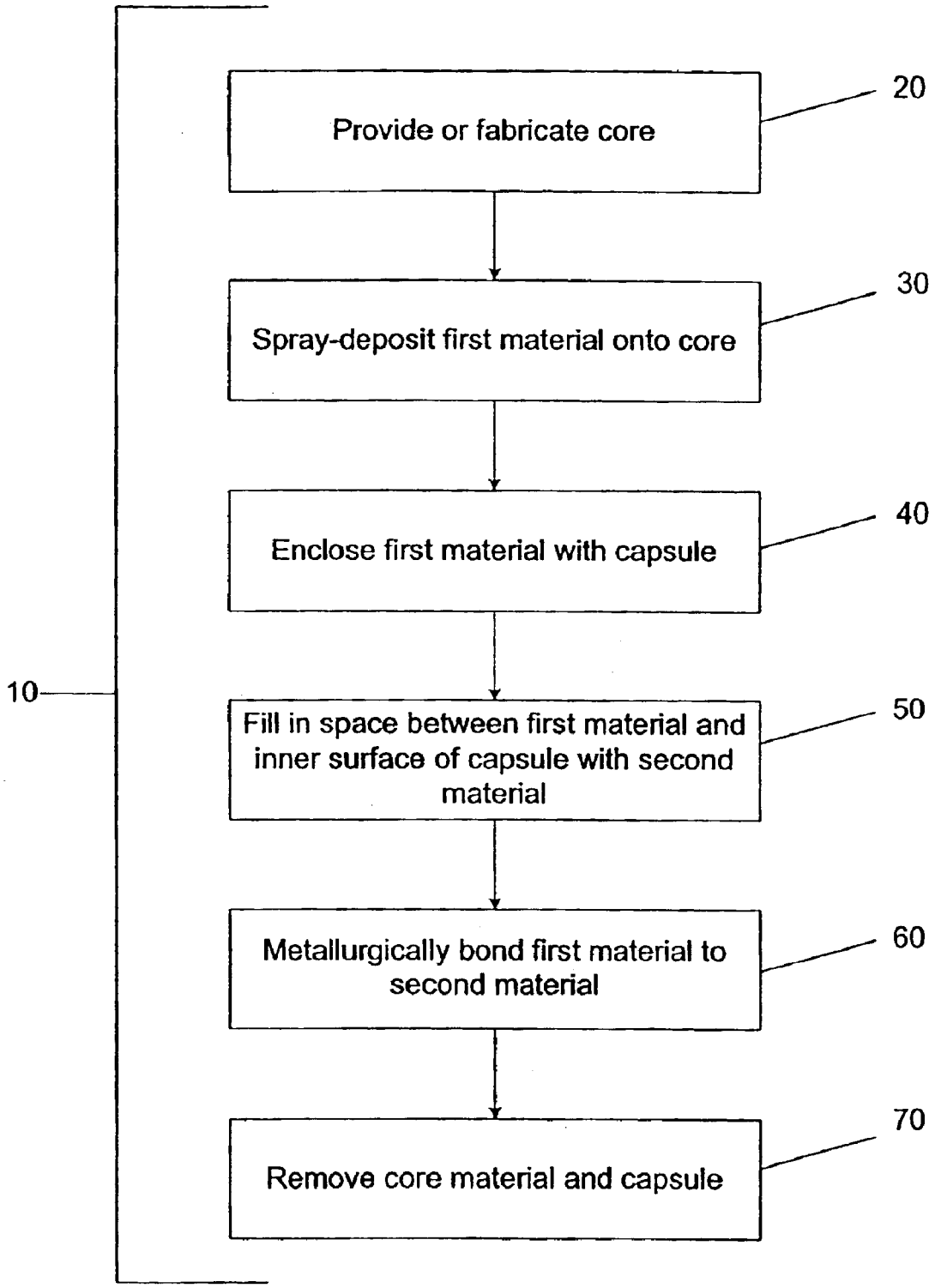
FIG. 1 is a flow diagram illustrating steps for fabricating a corrosion resistant component in accordance with the present invention.

FIG. 1 depicts a flow diagram 10 illustrating the steps of a process for fabricating a corrosion and erosion (i.e., wear) resistant component in accordance with the present invention.

This process allows for the convenient, inexpensive fabrication of durable, corrosion resistant components of various tailored sizes and shapes. The fabricated components are comprised of a minimum of two materials, at least one of which is strong yet inexpensive, and at least another of which is comparatively more expensive, but exhibits increased corrosion and/or erosion resistance vis-a-vis the other material.

The fabrication process entails applying one or more corrosion resistant first materials onto a sacrificial core or substrate and then enclosing this first material and the core to form surrounding capsule. Any space defined within the capsule is then substantially filled with a second material. The capsule is then sealed and processed to cause the second material to densify and to metallurgically bond to the first material at contact areas between the first and second materials. Thereafter, the core and capsule are removed via chemical and/or mechanical processes to yield a component with a linear or non-linear shape that approximates that of the space that existed within the capsule.

Figure 2:
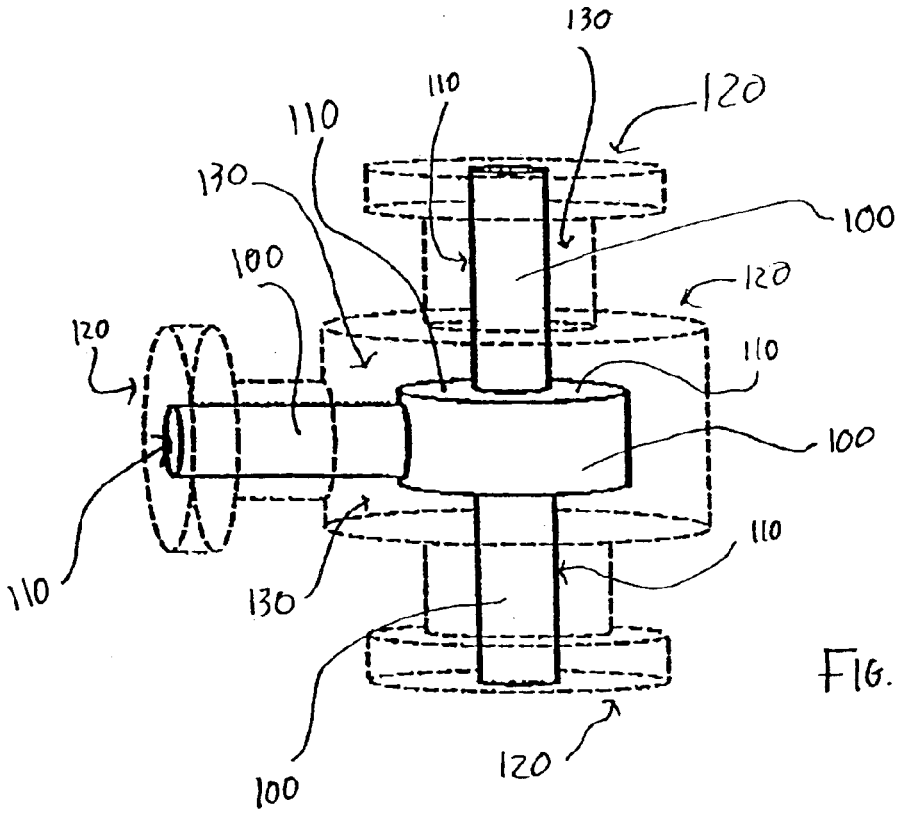
FIG. 2 is a schematic isometric view of a core and a capsule used in the fabrication of a corrosion resistant component in accordance with the process of FIG. 1.
Figure 3:
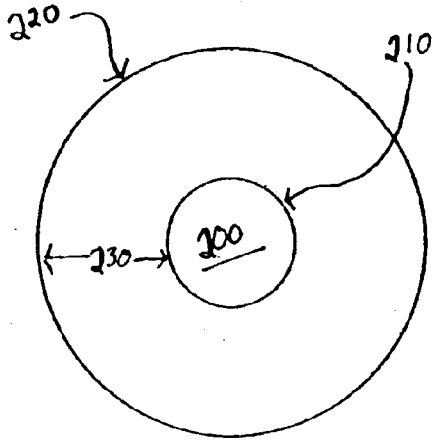
FIG. 3 is top view of an alternate embodiment of a core and capsule in accordance with the present invention.

At step 20 of the fabrication process of FIG. 1, a sacrificial core or substrate is provided. Exemplary cores 100, 200 are shown in FIGS. 2 and 3, the core 100 being useful in fabricating a valve component, and the core 200 being useful in fabricating a pipe or tube component. Once the core 100, 200 is prepared, the process continues to step 30, which entails applying one or more substantially corrosion and/or erosion resistant first materials onto some or substantially all of the outer surface 110, 210 of the core.

Application of the first material(s) may be accomplished via a number of techniques known in the art, including, but not limited to, spraying techniques, welding techniques, and chemical processes. Exemplary spraying techniques include both "spray to solid" and "spray to powder" techniques. Specific suitable spraying techniques include, but are not limited to, spray deposition (e.g., the Osprey process), plasma spraying, high velocity oxy-fuel (HVOF) spraying and wire thermal spraying.

Exemplary welding techniques include, but are not limited to, weld overlaying, plasma transfer arc welding, laser welding and gas metal arc welding, while exemplary chemical processes include, but are not limited to, electrolysis, chemical precipitation, adhesive bonding, chemical vapor deposition (CVD) and physical vapor deposition (PVD).

In an exemplary embodiment of the present invention, the first material is spray deposited onto the core in powder form in order to create a porous layer of first material, which, in turn, allows for penetration of subsequently added second material.

The thickness of the layer of the first material(s) will vary depending on a number of factors, such as the number of materials that form the layer, the operating environment (e.g., temperature, pressure, corrosivity and abrasiveness) to which the finished component is subjected, the desired amount/degree of corrosion resistance of the component, the size and shape of the component, etc. The selection of the appropriate thickness of the first material is routine to one of ordinary skill in the art.

Generally, when fabricating an industrial part such as the valve body shown in FIG. 2, or the pipe/tube shown in FIG. 3, the first material(s) should be applied to the outer surface 110, 210 of the core 100, 200 to form a layer with a total thickness in the range of about 0.05 inch to 0.5 inch (1.27 millimeter to 12.7 millimeters), with a thickness in the range of about 0.1 inch to 0.3 inch (2.54 millimeters to 7.26 millimeters) being preferred.

This first material layer may be comprised of one or more corrosion resistant materials, such as metal-based alloys, cermets and/or ceramics. Exemplary metal-based materials include, but are not limited to, stainless steels, nickel-based alloys such as Inconel 600, Inconel 625 and Inconel 800, cobalt-based alloys such as Stellite 1, Stellite 6, Tribaloy T400, and iron-based alloys such as A-286 and Incoloy 800. Exemplary cermet materials include, but are not limited to, Stelcar 1, JK-112 and JK9153, while an exemplary ceramic material is partially stabilized zirconia (PSZ).

These exemplary nickel-based alloys, cobalt-based alloys and cermet materials are available as spray deposits from commercial suppliers such as such as Deloro Stellite Co., Inc. of Goshen, Ind., while PSZ is available from commercial suppliers such as ICI Advanced Ceramics of Auburn, Calif.

Once the layer of first material(s) is applied to the sacrificial core 100, 200, the process continues to step 40 during which the first material(s) and the core are encased or otherwise entirely or partially enclosed by a surrounding capsule. Exemplary capsules 120 (for a valve component 100) and 220 (for a pipe/tube component 200) are shown, respectively, in FIGS. 2 and 3.

Once the core is encased, a void or space 130, 230 is created/defined between the capsule and the layer of first material on the outer surface 110, 210 of the core 100, 200. Thus, the size and shape of this space 130, 230 is dependant on the size and shape of the core 100, 200 and the capsule 120, 220, as well as the thickness of the first material that was spray-deposited on the outer surface 110, 210 of the core.

At step 50 of the fabrication process of FIG. 1, this space 130, 230 is at least partially filled with a second material such that the second material substantially surrounds or covers the layer of the first material on the core 100, 200. In an exemplary embodiment of the present invention, the space 130, 230 is substantially filled with a powder-based second material such that the second material is capable of penetrating the porous layer of first material.

The second material should be a relatively inexpensive, yet should possess the mechanical properties (e.g., strength, stiffness, durability) necessary to meet requirements of the ultimate usage conditions of the finished component. Moreover, it is understood that the second material may actually be comprised of more than one material.

Exemplary second materials for use in fabricating industrial components include, but are not limited to, duplex stainless steel alloys, 9Cr-1Mo steel, 4140 steel and 4340 steel. Each of these alloys is sold in powder form by commercial suppliers such as Deloro Stellite Co., Inc. of Goshen, Ind. and ANVAL, Inc. of Torshala Sweden.

Once the appropriate amount of second material is added, the capsule 120, 220 is hermetically sealed and outgased through an evacuation tube (not shown) at a temperature in the range of about 200° F. to 2000° F., preferably in the range of about 400° F. to 600° F. The outgasing process is performed until a predetermined vacuum level within the capsule is reached, wherein that vacuum level signifies that most, if not all, of the moisture that were contained within the powdered second material have been eliminated. Typically, this predetermined vacuum level is in the range of about 50 microns to 200 microns, with about 100 microns being the approximate vacuum level being preferred. In order to obtain a vacuum level of approximately 100 microns, the entire outgasing process usually lasts in the range of about 4 to 48 hours, the exact duration depending on such factors as the weight and moisture content of the powder.

Once the outgasing process is completed, the evacuation tube is sealed via a method known in the art, such as hydraulic crimping and/or welding, in order to provide a hermetic seal around the capsule and, thus, around the first material and core.

At step 60 of the FIG. 1 process, the sealed capsule 120, 220 is treated in order to cause the first material to densify (i.e., to remove residual pores and voids within the first material) and to metallurgically or diffusively bond it to the second material. This treatment can occur via a number of techniques known in the art including, but not limited to, press and sinter, Ceracon, Fluid Die, and Rapid Omnidirectional Compaction (ROC) but, preferably, occurs by hot isostatically pressing (HIP) the capsule 120, 220 for a predetermined time at a predetermined temperature and a selected pressure.

In an exemplary embodiment of the present invention, the temperature during HIP treatment of the capsule is in the range of about 1500° F. to 2500° F., preferably in the range of about 1800° F. to 2200°, and most preferably in the range of about 2000° F. to 2100° F., while the HIP pressure is in the range of about 5000 psi to 45000 psi, preferably in the range of about 13000 psi to 16000 psi, and most preferably in the range of 14500 psi to 15500 psi. The time during which the capsule is HIPed is in the range of about two hours to six hours, preferably in the range of about three to five hours, and most preferably approximately four hours.

Following treatment of the capsule, the first and second materials are strongly metallurgically bonded together. In an embodiment in which a compositional gradient is created between the first and second materials during the HIP treatment. This gradient, in turn, serves to diffuse the stresses generated by differences in thermal expansion that may exist between the first material and second material. Because these stresses are diffused, a component fabricated as such not only is accurately shaped and corrosion resistant, but also is less susceptible to cracking and, therefore, is highly durable.

Following the HIP treatment, the process continues to step 70, during which the shaped core and capsule are removed/eliminated. A number of chemical and mechanical techniques exist in the art to eliminate the core and capsule, including, but not limited to, chemical or acid pickling, and/or machining.

In order for the core and capsule to be easily removable via, for example, pickling or machining techniques, while still ensuring that the shape and/or mechanical properties of the component are not compromised during the core and capsule removal process, the core and capsule are preferably made of a material that is more susceptible to pickling or machining than the first and second materials that comprise the component.

Many such materials exist, including, but not limited to, sheet metals such as a carbon steel sheet metal. Exemplary carbon steel sheet metals include, but are not limited to, AISI 1010, AISI 1018 and AISI 1020. One of ordinary skill in the art will readily appreciate that although the core 100, 200 and capsule 120, 220 are generally constructed of the same material, they may be formed from different materials as well.

Once the core and capsule have been eliminated, the component is considered completely or substantially fabricated. Exemplary components include, but are not limited to, tubes, pipes, and valves. The finished component can be linear or non-linear in shape, wherein exemplary non-linear shapes for the components include, but are not limited to, a "T-shape," a cross shape, and any other shape that includes a bend, junction or intersection.

Figure 4:
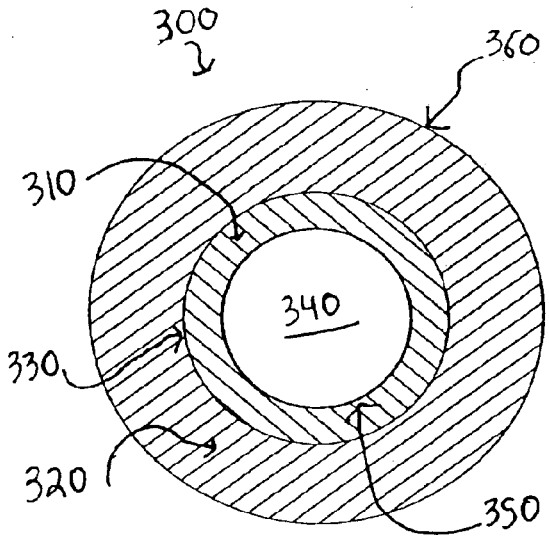
FIG. 4 is a cross-sectional top view of a corrosion resistant component fabricated in accordance with the present invention.

A fabricated pipe/tube component 300 made using the core and capsule of FIG. 3 is shown in FIG. 4. The component 300 includes a layer 310 of the first material and a layer 320 of the second material that are metallurgically bonded at their junction 330. The component 300 further includes a hollow cavity 340 where the core, prior to being removed, was located. The inner surface 350 of the layer 310 of first material has a shape that resembles the approximate shape of the outer surface of the core, while the outer surface 360 of the layer 320 of the second material has a shape that resembles the approximate shape of the inner surface of the capsule.

Fabrication of a component in accordance with the process of FIG. 1 generally yields a "near net shape" component—that is, a component that requires little to no significant post-fabrication surface treatment. It is understood, however, that the external surface 350 of the finished component may require some surface treatment by one or more surface treatment methods (e.g., cleaning, machining, grit blasting and/or polishing) known in the art.

One skilled in the art will appreciate further features and advantages of the invention based on the above-described embodiments. Accordingly, the invention is not to be limited by what has been particularly shown and described, except as indicated by the appended claims. All publications and references cited herein are expressly incorporated herein by reference in their entirety.

What is claimed is:

1. A method of fabricating a component, comprising the steps of:

providing a sacrificial core having an outer surface of a predetermined shape;

applying a first material onto at least a portion of the outer surface of the sacrificial core by a spraying technique selected from the group consisting of spray deposition, plasma spraying, and high velocity oxy-fuel spraying;

substantially enclosing the first material and the sacrificial core within a capsule;

introducing a quantity of a second material, in powder form, within the capsule such that at least some of the first material is in contact with at least some of the second material; and causing the first material to metallurgically bond to the second material using hot isostatic pressing technique.

2. The method of claim 1, wherein the first material is more corrosion resistant than the second material.

3. The method of claim 1, further comprising the step of:

following the step of causing the first material to metallurgically bond to the second material, removing the sacrificial core and the capsule.

4. The method of claim 3, wherein the sacrificial core and the capsule are each removed via a process selected from the group consisting of machining and pickling.

5. The method of claim 1, wherein the step of applying the first material onto at least a portion of the sacrificial core is accomplished via one of a spraying technique, a welding technique and a chemical process.

6. The method of claim 1, wherein the first material is selected from the group consisting of metal-based alloys, cermets and ceramics.

7. The method of claim 1, wherein the first material is selected from the group consisting of nickel-based alloys, cobalt-based alloys, iron-based alloys and stainless steels.

8. The method of claim 1, wherein the second material is a metal-based alloy.

9. The method of claim 8, wherein the second material is a stainless steel.

10. The method of claim 1, wherein the core and the capsule are each formed from a carbon steel sheet metal.

11. The method of claim 1, wherein the first material and the second material are metallurgically bonded together via hot isostatic pressing for a predetermined time at a predetermined temperature and a selected pressure.

12. The method of claim 11, wherein the predetermined temperature is in the range of about 1500° F. to 2500° F., wherein the selected pressure is in the range of about 5000 psi to 45000 psi, and wherein the predetermined time is in the range of about two hours to six hours.

13. The method of claim 12, wherein the predetermined temperature is in the range of about 1800° F. to 2200° F., wherein the selected pressure is in the range of about 13000 psi to 16000 psi, and wherein the predetermined time is in the range of about three hours to five hours.

14. The method of claim 13, wherein the predetermined temperature is in the range of about 2000° F. to 2100° F., wherein the selected pressure is in the range of about 14500 psi to 15500 psi, and wherein the predetermined time is about four hours.

15. The method of claim 1, wherein the first material is more wear resistant than the second material.

16. A method of fabricating a component, comprising the steps of:

providing a core having a predetermined shape;

spray-depositing a first material onto at least a portion of the core;

substantially enclosing the first material within a capsule;

introducing a quantity of a second material in powder form within the capsule, wherein the second material is less corrosion resistant and/or wear resistant than the first material;

hot isostatically pressing the first material for a time in the range of about two hours to about six hours at a temperature in the range of about 1500° F. to 2500° F. and at a pressure in the range of about 5000 psi to 45000 psi, such that the first material metallurgically bonds to the second material; and removing the core and the capsule to yield a fabricated component having a hollow cavity with an inner surface formed of the first material.

17. A method of fabricating a component, comprising the steps of:

providing a core having a predetermined shape;

spray-depositing a first material onto at least a portion of the core;

substantially enclosing the first material within a capsule;

introducing a quantity of a second material in powder form within the capsule, wherein the second material is less corrosion resistant and/or wear resistant than the first material;

hot isostatically pressing the first material at a pressure in the range of about 5000 psi to 45000 psi, such that the first material metallurgically bonds to the second material; and removing the core and the capsule to yield a fabricated component having a hollow cavity with an inner surface formed of the first material.

* * * * *